US005977853A

United States Patent [19]

Ooi et al.

[11] Patent Number: 5,977,853

[45] **Date of Patent: *Nov. 2, 1999**

[54] CHOKE COIL FOR ELIMINATING COMMON MODE NOISE AND NORMAL MODE NOISE

[75] Inventors: Takaaki Ooi, Takefu; Kouichi Yamaguchi; Tatsuyuki Yamada, both of Fukui-ken; Iwao Fukutani, Takefu, all of Japan

[73] Assignee: Murata Manufacturing Co., Ltd., Nagaokakyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/597,461

[22] Filed: Feb. 2, 1996

[30] Foreign Application Priority Data

Feb. 3, 1995 [JP] Japan ..... 7-017158

[51] Int. Cl.[6] ..... H01F 27/06; H01F 27/26; H01F 27/30

[52] U.S. Cl. ..... 336/65; 336/160; 336/212; 336/214

[58] Field of Search ..... 336/210, 212, 336/214, 215, 65, 160, 165, 178, 155

[56] References Cited

U.S. PATENT DOCUMENTS

| | | | |
|---|---|---|---|
| 2,264,057 | 11/1941 | Treanor | 336/212 |
| 3,454,916 | 7/1969 | Hoover | 336/212 |
| 3,739,255 | 6/1973 | Leppert | 336/212 |
| 4,176,333 | 11/1979 | Bennon et al. | 336/215 |
| 4,520,335 | 5/1985 | Rauch et al. | 336/212 |
| 4,835,497 | 5/1989 | Takagi et al. | 336/215 |
| 5,266,916 | 11/1993 | Kijima | 336/212 |
| 5,373,277 | 12/1994 | Naito | 336/212 |

FOREIGN PATENT DOCUMENTS

| | | | |
|---|---|---|---|
| 60-143612 | 7/1985 | Japan | 336/198 |

*Primary Examiner*—Thomas J. Kozma
*Attorney, Agent, or Firm*—Burns, Doane, Swecker & Mathis, LLP

[57] ABSTRACT

There is provided a choke coil having a sufficient noise eliminating effect against common mode and normal mode noises. The choke coil has two bobbins, a pair of windings wound around the respective bobbins, first and second magnetic cores which are each inserted in cylindrical body portions of the bobbins at one side thereof, and a support member for supporting the cores. The first magnetic core is in the form of the character B and made of a material having lower permeability. The second magnetic core is in the form of the character D and made of a material having higher permeability. A predetermined gap is maintained between the cores by a spacer provided on the top surface of the support member.

6 Claims, 5 Drawing Sheets

CHOKE COIL FOR ELIMINATING COMMON MODE NOISE AND NORMAL MODE NOISE

BACKGROUND OF THE INVENTION

1. Field of the Invention

The present invention relates to a choke coil which is primarily used for eliminating noises generated by electronic equipment and the like.

2. Description of the Related Art

There are two modes for circulating noise. One is a normal mode (a differential mode) which circulates noise by generating a voltage difference between power supply lines. The other is a common mode which circulates noise by generating a voltage difference between the power supply lines and ground, but without a voltage difference between the power supply lines. The noise current direction of the normal mode is in the same direction as the current direction of the power supply. The noise current direction of the common mode follows a different loop than the current of the power supply. Choke coils are designed to reduce or eliminate these types of noise.

A common mode choke coil generally includes normal mode leakage inductance components, although at a low level. It is therefore also effective for normal mode noises. However, for normal mode noises at a high level, it has been necessary to use a separate normal mode choke coil to eliminate the noises.

In the case of a common mode choke coil having normal mode leakage inductance components at a relatively high level, leakage flux has sometimes adversely affected adjacent circuits. This has necessitated countermeasures such as a magnetic shield provided around a common mode choke coil.

Since it has not been possible for a single conventional choke coil to eliminate both common mode and normal mode noises sufficiently, in order to eliminate both common mode and normal mode noises, it has been necessary to mount two choke coils, i.e., a common mode choke coil and a normal mode choke coil, on a printed circuit board or the like. This has resulted in a problem in that a large area is consumed on the printed circuit board or the like.

Further, a magnetic shield provided around a choke coil has led to an increase in the cost of the choke coil.

It is therefore an object of the present invention to provide a choke coil having a sufficient noise eliminating effect against common mode and normal mode noises.

SUMMARY OF THE INVENTION

In order to achieve the above-described object, according to the present invention, there is provided a choke coil characterized in that it includes:

(a) a pair of windings;

(b) a bobbin having a cylindrical body portion around which the pair of windings are wound;

(c) a first magnetic core made of a material having lower permeability for forming a closed magnetic circuit and a second magnetic core made of a material having higher permeability for forming a closed magnetic circuit which are each inserted in a hole of the cylindrical body portion; and (d) a support member for supporting the two magnetic cores.

A choke coil according to the present invention is further characterized in that it includes a spacer provided on the support member for forming a gap between the two magnetic cores.

With the above-described configuration, on one hand, when a common mode noise current flows through the pair of windings, magnetic flux is generated at each winding. The magnetic fluxes are combined with each other and the combined flux is attenuated as a result of the conversion of the same into thermal energy in the form of eddy current loss or the like that occurs in the second magnetic core made of a material having higher permeability and forming a closed magnetic circuit. This eliminates the common mode noise current. On the other hand, when a normal mode noise current flows through the pair of windings, magnetic flux is generated at the windings. This magnetic flux circulates through the first magnetic core made of a material having lower permeability and forming a closed magnetic circuit. This magnetic flux is attenuated as a result of the conversion of the same into thermal energy in the form of eddy current loss or the like. This eliminates the normal mode noise current.

Further, the spacer provided on the support member maintains a gap of a predetermined dimension between the first and second magnetic cores. As a result, the reluctance between the first and second magnetic cores is increased, and this suppresses the leakage of the magnetic flux generated in the first magnetic core by the normal mode current to the second magnetic core.

DETAILED DESCRIPTION OF THE PREFERRED EMBODIMENTS

Embodiments of a choke coil according to the present invention will now be described with reference to the accompanying drawings.

A first embodiment of the present invention will be described with reference to FIGS. 1 through 9.

Figure 1:
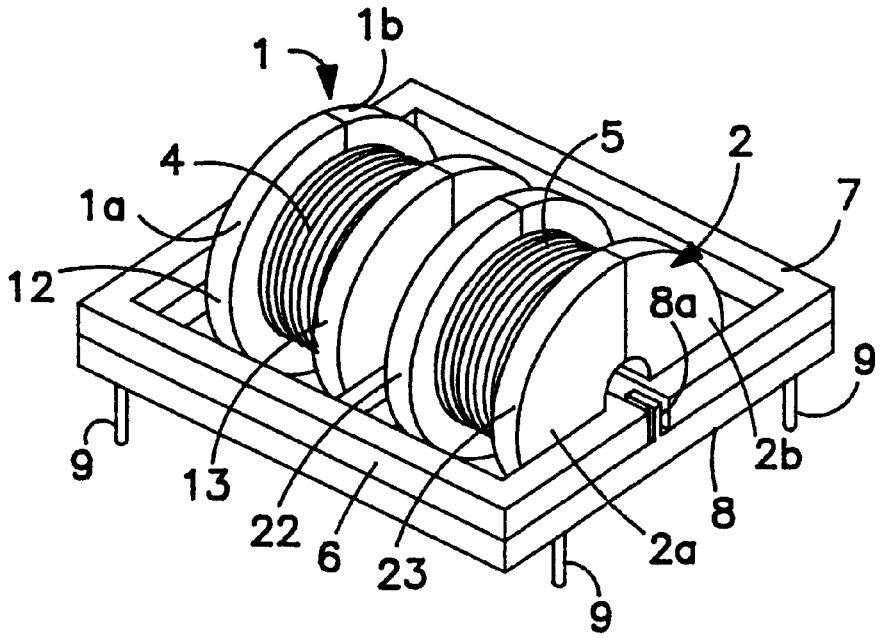
FIG. 1 is a perspective view of a first embodiment of a choke coil according to the present invention.

As shown in FIG. 1, the choke coil is constituted by first and second bobbins 1 and 2, windings 4 and 5 wound around the bobbins 1 and 2, respectively, a first magnetic core 6, a second magnetic core 7, and a support member 8.

The bobbins 1 and 2 are each divided into two bobbin elements 1*a,* 1*b* and 2*a,* 2*b,* respectively, in a direction parallel to the axis thereof and are formed of resin such as polybutylene terephthalate. The first bobbin 1 is obtained by bonding two bobbin elements 1*a* and 1*b* using adhesive or the like. The first bobbin 1 has a cylindrical body portion 11 (FIG. 4) and flange portions 12 and 13 provided on both ends of the body portion 11. Similarly, the second bobbin 2 is obtained by bonding two bobbin elements 2*a* and 2*b.* The second bobbin 2 has a cylindrical body portion 21 and flange portions 22 and 23 provided on both ends of the body portion 21 (see FIG. 4). Holes 11*a* and 21*a* in the cylindrical body portion 11 and 21, respectively, have a circular transverse cross-section. However, the holes may have any transverse sectional shape, e.g., rectilinear shapes.

As used herein, "cylindrical" is to be given its broad mathematical definition as a surface generated by a straight line which moves so that it always intersects a given plane (directrix) and remains parallel to a fixed line that intersects the plane of the directrix. This includes circular cylinders, quadric cylinders, elliptic cylinders, parabolic cylinders, hyperbolic cylinders, as well as cylinders whose directrix and right sections are polygons.

The first magnetic core 6 is molded in the form of the character B. One side 6*a* of this core is inserted in the holes 11*a* and 21*a* of the cylindrical body portions 11 and 21 of the bobbins 1 and 2. The first magnetic core 6 is made of a material having low permeability, e.g., a material having relative permeability (H/B) in the range from 1 to several tens or in the range from several tens to several hundreds. Specifically, dust cores, silicon steel, a resin in which ferrite powder is mixed, etc. are used.

The second magnetic core 7 in the form of the character D. One side 7*a* is inserted in the holes 11*a* and 21*a* of the cylindrical portions 11 and 21 of the bobbins 1 and 2. The second magnetic core 7 is made of a material having higher permeability, e.g., a material having relative permeability of several thousands. Specifically, ferrite, amorphous materials, etc. are used.

Figure 2:
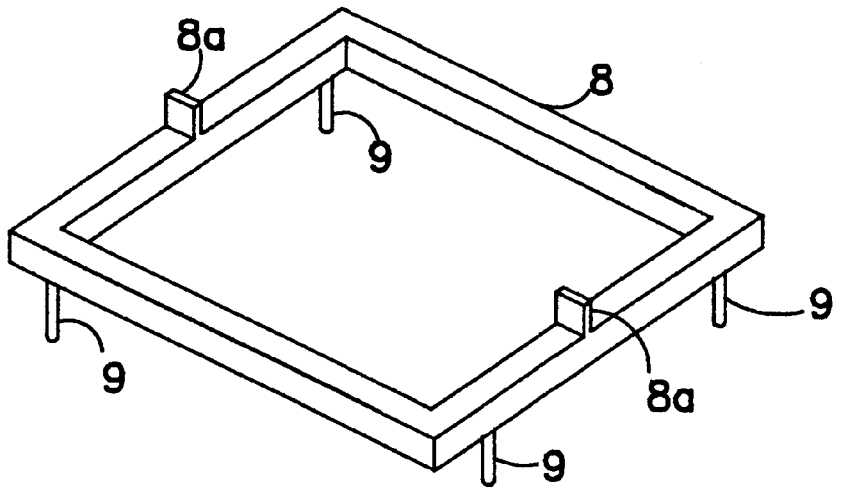
FIG. 2 is a perspective view of a support member used in the choke coil shown in FIG. 1.

As shown in FIG. 2, the support member 8 is molded in the form of a frame, and a spacer 8*a* is provided on the left and right sides on the top of the frame for forming a gap of a predetermined dimension between the first magnetic core 6 and the second magnetic core 7. Further, a terminal 9 is erected at each of the corners of the bottom surface of the support member 8. The first magnetic core 6 and the second magnetic core 7 are bonded to the upper surface of the support member 8 using an adhesive or the like with the spacer 8*a* interposed therebetween.

The windings 4 and 5 are respectively wound around the cylindrical body portions 11 and 21 of the bobbins 1 and 2, and the starting and terminating ends of each winding are fixed to the terminals 9 provided on the support member 8. In this first embodiment, the winding operation is carried out by rotating the bobbins 1 and 2 in which the magnetic cores 6 and 7 are inserted about the sides 6*a* and 7*a* of the cores 6 and 7, respectively, to wind the windings 4 and 5 around the body portions 11 and 21, respectively.

Figure 3:
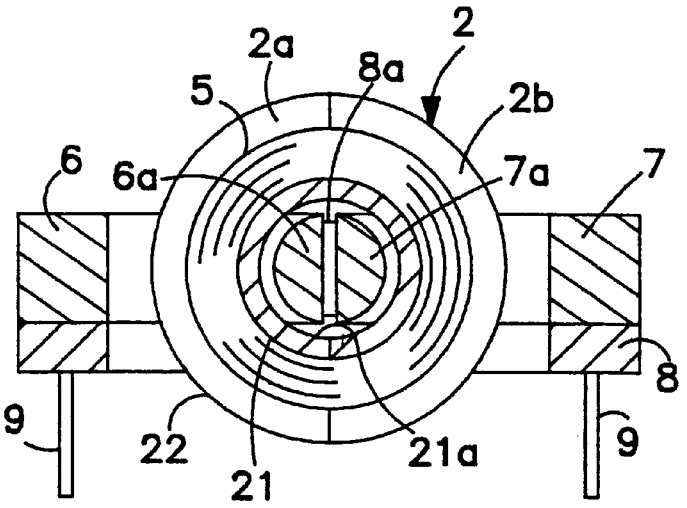
FIG. 3 is a vertical sectional view of the choke coil shown in FIG. 1.

The choke coil of the first embodiment will now be described in detail with reference to FIG. 3 and FIG. 4. Each of the sides 6*a* and 7*a* of the magnetic cores 6 and 7 inserted in the bobbins 1 and 2 has a substantially semicircular cross-section and is designed so as to maximize the sectional area thereof within the limited dimensions of the holes 11*a* and 21*a*. The purpose is to increase the sectional area of the magnetic circuit for magnetic flux generated in the magnetic cores 6 and 7 by normal mode and common mode noises to thereby obtain higher normal mode and common mode inductance by decreasing the reluctance of the magnetic circuit.

A sufficient gap is maintained between the first magnetic core 6 and the second magnetic core 7 by the spacer 8*a*. The thickness of the spacer 8*a* is set so that the reluctance between the cores 6 and 7 is greater than the reluctance between the points A and B in FIG. 9. Specifically, the value of the thickness t of the spacer 8*a* is set to satisfy the following Equation (1) where the distance between the points A and B is represented by L and the relative permeability of the first magnetic core 6 is represented by $\mu$. This suppresses the leakage of the magnetic flux $\phi$3 and $\phi$4 generated at the windings 4 and 5, respectively, by a normal mode current from the first magnetic core 6 to the second magnetic core 7, thereby suppressing reduction of common mode inductance due to saturation.

$$t>(L/2\mu) \qquad \text{Equation (1)}$$

Figure 4:
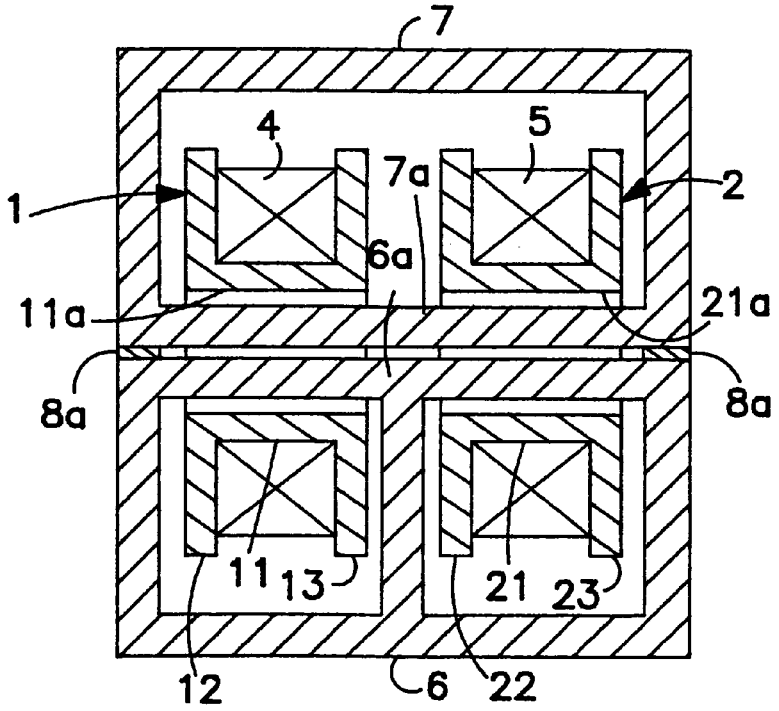
FIG. 4 is a horizontal sectional view of the choke coil shown in FIG. 1.
Figure 5:
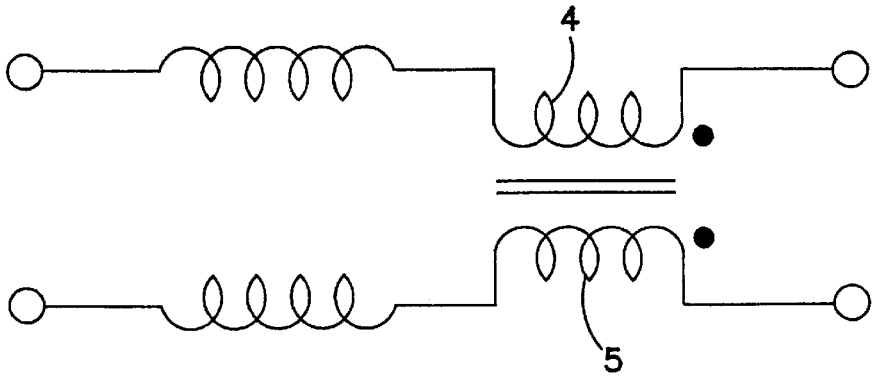
FIG. 5 is an electrical equivalent circuit diagram of the choke coil shown in FIG. 1.

Further, as shown in FIG. 4, the left half of the first magnetic core 6 forms a closed magnetic circuit which extends around the winding 4 while the right half forms a closed magnetic circuit which extends around winding 5. The second magnetic core 7 forms a closed magnetic circuit which extends around both of the windings 4 and 5. FIG. 5 is an electrical equivalent circuit diagram of this choke coil.

A common mode noise eliminating action of a choke coil having the above-described configuration will now be described with reference to FIG. 6 and FIG. 7.

Figure 6:
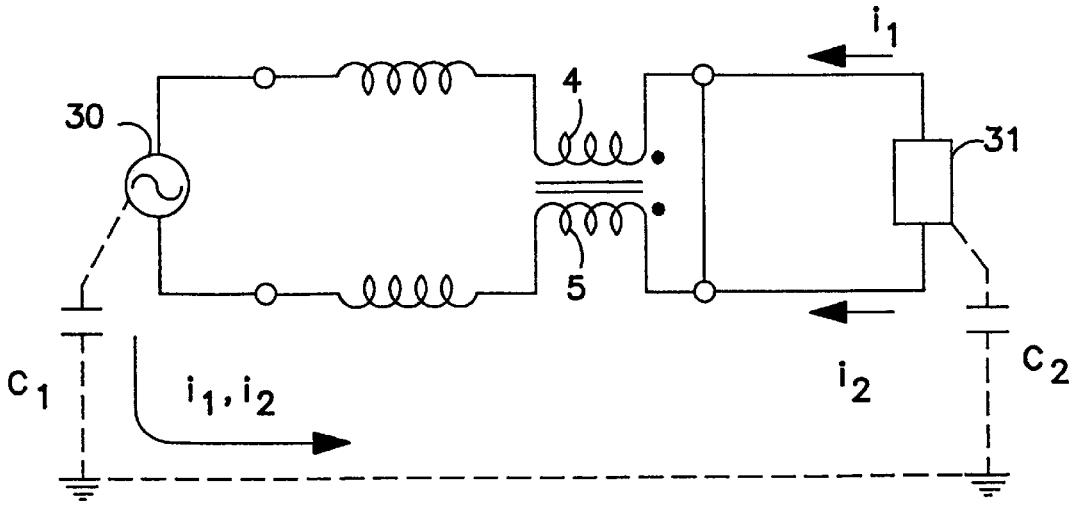
FIG. 6 is an electrical circuit diagram for explaining the elimination of common mode noises using the choke coil shown in FIG. 1.
Figure 7:
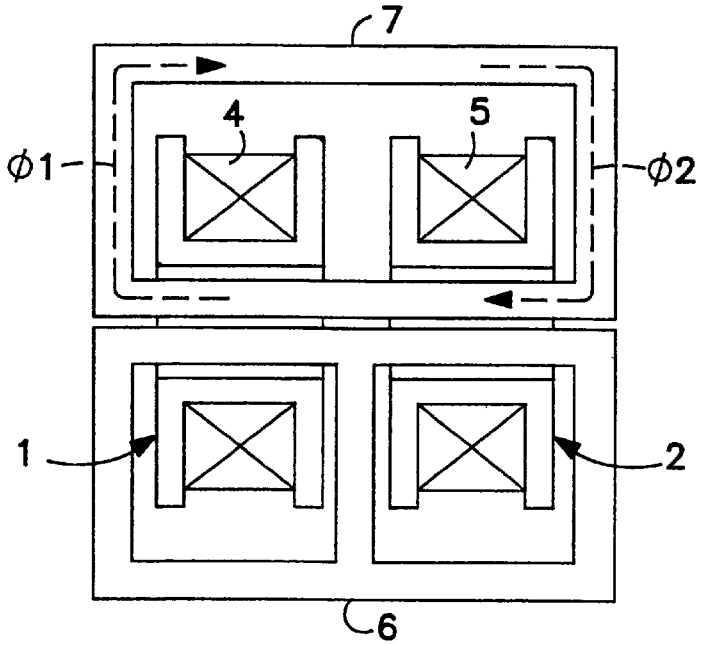
FIG. 7 is a magnetic circuit diagram for explaining the elimination of common mode noises using the choke coil shown in FIG. 1.

As shown in FIG. 6, the choke coil is electrically connected to two signal lines provided between a power supply 30 and a load 31 such as an electrical apparatus. A stray capacity C1 is generated between the power supply 30 and ground, and a stray capacity C2 is generated between the load 31 and ground. When common mode noise currents $i_1$ and $i_2$ flow through the two signal lines in the directions indicated by the arrows in FIG. 6, as shown in FIG. 7, the windings 4 and 5 generate magnetic flux $\phi$1 and $\phi$2, respectively. The combination of the magnetic, flux $\phi$1 and $\phi$2 gradually attenuate without, leaking out while it circulates through the closed magnetic circuit formed by the second magnetic core 7 made of having higher permeability. This is a result of the conversion of the magnetic flux $\phi$1 and $\phi$2 into thermal energy in the form of eddy current loss or the like. Thus, the common mode noise currents $i_1$ and $i_2$ are reduced.

Next, a normal mode noise eliminating action of the choke coil will now be described with reference to FIG. 8 and FIG. 9.

Figure 8:
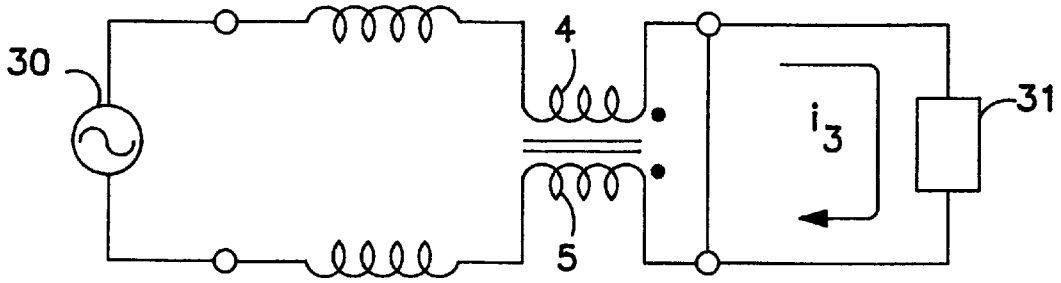
FIG. 8 is an electrical circuit diagram for explaining the elimination of normal mode noises using the choke coil shown in FIG. 1.
Figure 9:
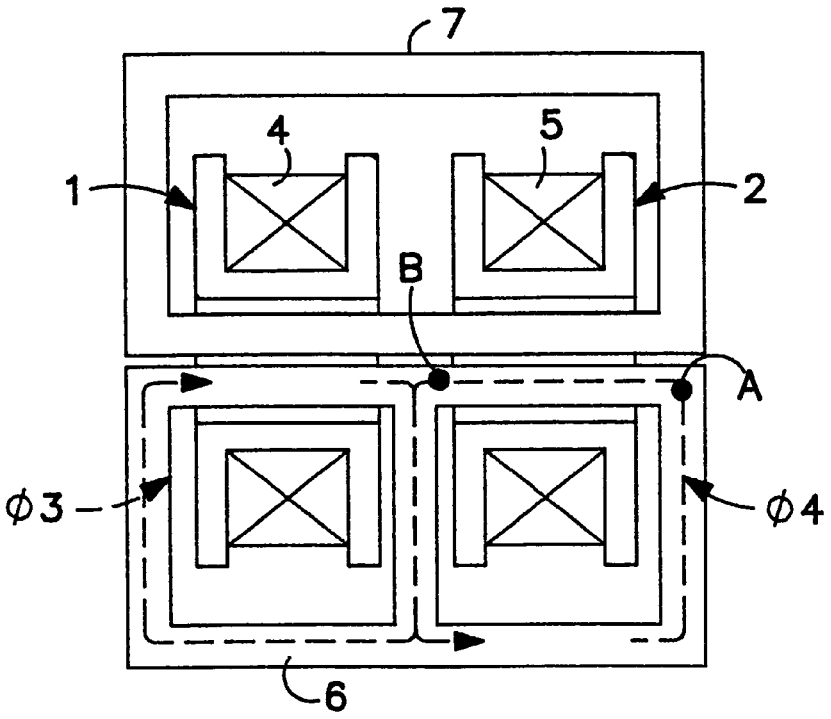
FIG. 9 is a magnetic circuit diagram for explaining the elimination of normal mode noises using the choke coil shown in FIG. 1.

When a normal mode noise current $i_3$ flows through each of the two signal lines in the direction indicated by the arrow in FIG. 8. As shown in FIG. 9, the windings 4 and 5 generate magnetic flux $\phi$3 and $\phi$4, respectively. Since a sufficient gap is maintained between the first magnetic core 6 and the second magnetic core 7 by the spacer 8*a,* the combination of the magnetic flux $\phi$3 and $\phi$4 is gradually attenuated as a result of the conversion of the same into thermal energy in the form of eddy current loss or the like which occurs while it circulates through the closed magnetic circuit formed by the first magnetic core 6 without leaking to the second magnetic core 7. Thus, the normal mode noise current $i_3$ is reduced.

A second embodiment of the present invention will now be described with reference to FIG. 10

Figure 10:
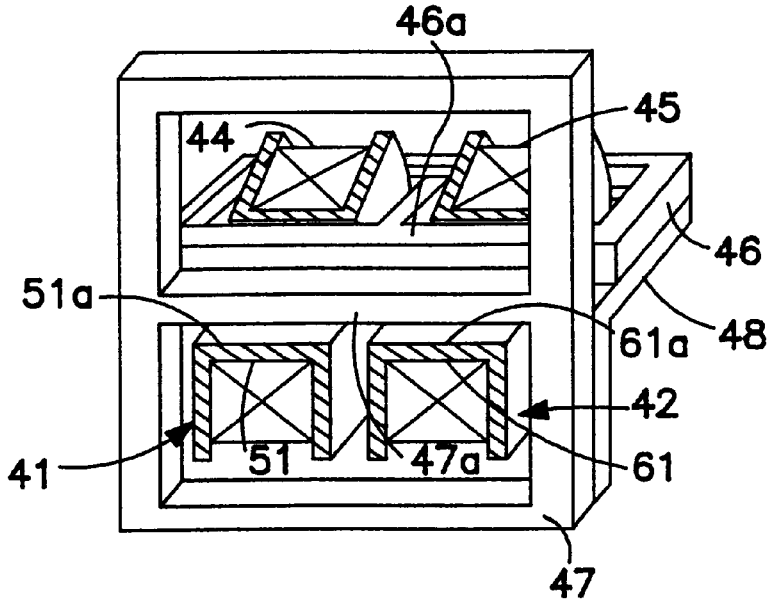
FIG. 10 is a partly sectional perspective view of a second embodiment of a choke coil according to the present invention.

As shown in FIG. 10, the choke coil of the second embodiment is constituted by, bobbins 41 and 42 made of resin, windings 44 and 45 wound respectively around cylindrical body portions 51 and 61 of the bobbins 41 and 42, a B-shaped first magnetic core 46 made of a material having lower permeability, a B-shaped second magnetic core 47 made of a material having higher permeability, and a support member 48. One side 46*a* of the first magnetic core 46 and a central element 47*a* of the second magnetic core 47 are inserted in holes 51*a* and 61*a*. The support member 48 is a frame-shaped element which has been bent in the form the character "L", and the cores 46 and 47 are bonded to the support member in a state wherein they are separated from each other. A choke coil having the above-described configuration has the same effect as that of the choke coil of the first embodiment.

A choke coil according to the present invention is not limited to the above-described embodiments and various modifications may be made thereto without departing from the principle of the present invention.

In addition to the combination of a B-shaped core and a D-shaped core, the magnetic core may be combinations of two B-shaped cores, a ⊕-shaped core and a D-shaped core, and a ⊕-shaped core and a B-shaped core. The cores are not limited to integral type, and split type cores such as combinations of U-shaped, E-shaped, and I-shaped cores may be used.

As apparent from the above description, according to the present invention, a first magnetic core forming a closed magnetic circuit made of a material having lower permeability and second magnetic core forming a closed magnetic circuit made of a material having higher permeability are inserted in respective bobbins around which a pair of windings are wound. As a result, magnetic flux generated by a common mode noise current and a normal mode noise current that flow through the pair of windings is attenuated as a result of the conversion of the same into thermal energy in the form of eddy current loss or the like that occurs in the first and second magnetic cores. This eliminates the common mode and normal mode noises. Further, the need for a magnetic shield around a choke coil is eliminated because there is no leakage of magnetic flux from the choke coil.

In addition, since a spacer is provided on the support member to form an interval between the two magnetic cores, a sufficient gap can be maintained between the two magnetic elements. This suppresses leakage of magnetic flux generated in the first magnetic core by normal mode noises to the second magnetic core, thereby suppressing saturation of magnetic flux due common mode noises.

Thus, there is provided a choke coil in which saturation of magnetic flux due to common mode noises is suppressed and which exhibits a sufficient noise eliminating effect against common mode and normal mode noises.

While specific illustrated embodiments have been shown and described, it will be appreciated by those skilled in the-art that various modifications, changes, and additions can be made to the invention without departing from the spirit and scope thereof as set forth in the following claim.

What is claimed is:

1. A choke coil comprising:

a pair of windings;

a bobbin having a cylindrical body portion around which one of said pair of windings is wound;

a first magnetic core made of a material having lower permeability for forming a closed magnetic circuit;

a second magnetic core made of a material having higher permeability for forming a closed magnetic circuit and is a B-shaped core, wherein only a portion of said first magnetic core and only a center most portion of said second magnetic core are located in a hole of said cylindrical body portion; and a support member individually supports each of said two magnetic cores.

2. The choke coil according to claim 1, further comprising a spacer provided on said support member for forming a gap between said two magnetic cores.

3. A choke coil comprising:

a pair of windings;

a bobbin having a cylindrical body portion around which both of said pair of windings are wound;

a first magnetic core made of a material having lower permeability for forming a closed magnetic circuit;

a second magnetic core made of a material having higher permeability for forming a closed magnetic circuit and is a B-shaped core, wherein only a portion of said first magnetic core and only a center most portion of said second magnetic core are located in a single hole of said cylindrical body portion; and a support member individually supports each of said two magnetic cores.

4. A choke coil comprising:

a pair of windings;

a pair of bobbins each having a cylindrical body portion, wherein one of said pair of windings is wound around one of said cylindrical body portion and the other of said pair of windings is wound around the other of said cylindrical body portion;

a first magnetic core made of a material having lower permeability for forming a closed magnetic circuit;

a second magnetic core made of a material having higher permeability for forming a closed magnetic circuit and is a B-shaped core, wherein only a portion of said first magnetic core and only a center most portion of said second magnetic cores are each located in a single hole of each of said cylindrical body portions, said holes being coaxially aligned; and a support member individually supports each of said two magnetic cores.

5. The choke coil according to claim 1, further comprising a second bobbin having a second cylindrical body portion around which the one of said pair of windings is wound, wherein said first magnetic core and second magnetic core are each inserted in a hole in said second cylindrical body portion.

6. The choke coil according to claim 1, wherein the first magnetic core has a shape similar to the letter B.

* * * * *